US007201205B2

(12) United States Patent
Lyness et al.

(10) Patent No.: US 7,201,205 B2
(45) Date of Patent: Apr. 10, 2007

(54) INTERIOR WINDOW WITH INTEGRATED BLIND

(76) Inventors: Patrick L. Lyness, 501 S. Virginia St., Terrell, TX (US) 75160; Rita Lyness, 501 S. Virginia St., Terrell, TX (US) 75160

( * ) Notice: Subject to any disclaimer, the term of this patent is extended or adjusted under 35 U.S.C. 154(b) by 555 days.

(21) Appl. No.: 10/793,752

(22) Filed: Mar. 8, 2004

(65) Prior Publication Data

US 2005/0210780 A1 Sep. 29, 2005

(51) Int. Cl.
*E06B 9/264* (2006.01)

(52) U.S. Cl. ..... 160/107; 160/34

(58) Field of Classification Search ..... 160/107, 160/98, 34, 176.1 R, 168.1 R; 49/86.1, 87.1
See application file for complete search history.

(56) References Cited

U.S. PATENT DOCUMENTS

| | | | | |
|---|---|---|---|---|
| 3,022,549 | A | 2/1962 | Cummings | |
| 3,153,819 | A | 10/1964 | Bond | |
| 3,201,832 | A | 8/1965 | Hordis et al. | |
| 3,253,644 | A | 5/1966 | Gotoh et al. | |
| 3,326,267 | A * | 6/1967 | Hauck | 160/107 |
| 3,389,737 | A | 6/1968 | Arnold et al. | |
| 3,443,624 | A * | 5/1969 | Toth | 160/107 |
| 4,369,828 | A | 1/1983 | Tatro | |
| 4,456,049 | A * | 6/1984 | Vecchiarelli | 160/176.1 R |
| 4,553,580 | A * | 11/1985 | Christoffersson | 160/172 R |
| 4,602,456 | A * | 7/1986 | Tatro | 49/74.1 |
| 4,687,040 | A * | 8/1987 | Ball | 160/107 |
| 5,497,820 | A * | 3/1996 | Drake, III | 160/107 |
| 5,769,142 | A | 6/1998 | Nicolosi | |
| 5,826,638 | A | 10/1998 | Jelic | |
| 6,059,006 | A | 5/2000 | Rossini | |
| 6,065,524 | A | 5/2000 | Rossini | |
| 6,070,638 | A | 6/2000 | Jelic | |
| 6,332,491 | B1 | 12/2001 | Rossini | |
| 6,550,520 | B1 | 4/2003 | Rossini et al. | |
| 6,601,633 | B2 | 8/2003 | Sun et al. | |
| 2002/0038694 | A1 | 4/2002 | Levert | |
| 2003/0066614 | A1 | 4/2003 | Sun et al. | |

* cited by examiner

*Primary Examiner*—David Purol
(74) *Attorney, Agent, or Firm*—Richard C. Litman

(57) ABSTRACT

The interior window with integrated blind is a window adapted for use in a hospital setting to provide a patient with privacy in his or her hospital room while at the same time allowing a doctor or nurse to easily view the patient. The window includes: a substantially airtight encasement formed from two panes of glass that are secured to opposite sides of a spacer frame, a blind assembly encased within the airtight encasement, and a separate blind control extending from each of the two sides of the airtight encasement to allow for adjustment of the blind from either side of the wall in which the window is installed. The window is specifically dimensioned to fit in the glazing pocket of a window frame for a commercial building.

An alternative embodiment, configured for areas of a hospital where control of the blind is appropriate from only one side of the window, includes only one blind control. This embodiment is identical to the first embodiment with the exception that one of the blind controls is missing.

3 Claims, 4 Drawing Sheets

INTERIOR WINDOW WITH INTEGRATED BLIND

BACKGROUND OF THE INVENTION

1. Field of the Invention

The present invention relates to windows, and more particularly, to an interior window having a blind assembly encased between two panes of glass, with the blind being adjustable from either side of the interior wall in which the window is installed.

2. Description of the Related Art

In a hospital setting, it is common to have an interior window installed in a wall separating a patient's room from a nurses' station or from a secured hallway. Such a window allows a doctor or nurse to easily view the patient without having to enter the patient's room and disturb or awaken the patient. Often, to afford the patient some privacy, curtains or blinds are secured to the frame of the window. However, when the curtains or blinds are secure to the side of the window in the patient's room, the doctor or nurse cannot easily check on the patient when the curtains or blinds are closed. Instead, the doctor or nurse must first enter the patient's room to open the curtains or blinds thereby disturbing the patient and defeating the purpose of the interior window. Likewise, when the curtains or blinds are mounted to the side of the window in the nurses' station or hallway, the patient is unable to easily close the curtains or blinds when privacy is desired.

Similar problems arise when the interior window is double paned with an integrated blind assembly positioned between the two panes of glass. With such a window, the control for the blinds must be mounted on either the patient's side of the window or the doctor and nurses' side of the window. Thus, if mounted on the patient's side, the doctor or nurse will still have to enter the patient's room when the blinds are closed, and if mounted on the doctor and nurses' side, the patient cannot easily close the blinds when privacy is desired.

Furthermore, prior art windows with integrated blinds are not configured to fit in the glazing pocket of a standard size window frame used in a commercial building. Because known windows with integrated blinds are thicker than the glazing pocket in a standard window frame, which varies between ¼ of an inch and one inch, the use of these windows requires the expense of non-standard window frames.

Consequently, an interior window with integrated blinds that can be controlled from either side of the wall in which the window is installed and that fits in a standard-sized commercial window frame is desired.

Patents and publications for windows with an integrated blind having a single blind control include U.S. Pat. No. 3,022,549 issued Feb. 27, 1962 to R. J. Cummings (adjustable shutter in hermetically sealed casing); U.S. Pat. No. 3,153,819 issued Oct. 27, 1964 to J. M. Bond (combined blind and window unit); U.S. Pat. No. 3,201,832 issued Aug. 24, 1965 to V. A. Hordis et al. (hermetically sealed window and blind unit); U.S. Pat. No. 3,253,644 issued May 31, 1966 to K. Gotoh et al. (double glazing window and the like having a blind therein); U.S. Pat. No. 3,389,737 issued Jun. 25, 1968 to B. C. Arnold, et al. (Venetian blind for double glazed sash); U.S. Pat. No. 4,369,828 issued Jan. 25, 1983 to M. J. Tatro (supplemental window and blind unit); U.S. Pat. No. 5,769,142 issued Jun. 23, 1998 to G. Nicolosi (device for operating Venetian blinds by magnetic mechanism); U.S. Pat. Nos. 5,826,638 and 6,070,638 issued Oct. 27, 1998 and Jun. 6, 2000, respectively, to R. Jelic (window having a blind between two panes of glass); U.S. Pat. Nos. 6,059,006; 6,065,524; and 6,332,491 issued May 9, 2000, May 23, 2000 and Dec. 25, 2001, respectfully, to M. Rossini (actuation device and actuation assembly for a Venetian blind or the like arranged inside a double-glazing unit); U.S. Pat. No. 6,550,520 issued Apr. 22, 2003 to M. Rossini et al. (insulating glazing unit provided with a blind); U.S. Pat. Pub. No. 2003/0066614 published on Apr. 10, 2003 and U.S. Pat. No. 6,601,633 issued Aug. 5, 2003 to L. Y. Sun et al. (insulating glass blind assembly); and U.S. Pat. Pub. No. 2002/0038694 published on Apr. 4, 2002 (combined multiple-glazed window and light control assembly).

Accordingly, none of the above inventions and patents, taken either singly or in combination, is seen to describe the instant invention as claimed and therefore an interior window with integrated blind solving the aforementioned problems is desired.

SUMMARY OF THE INVENTION

The interior window with integrated blind is a window adapted for use in a hospital setting to provide a patient with privacy in his or her hospital room while at the same time allowing a doctor or nurse to easily view the patient. The window includes: a substantially airtight encasement formed from two of panes of glass that are secured to opposite sides of a spacer frame, a blind assembly encased within the airtight encasement, and a separate blind control extending from each of the two sides of the airtight encasement. The two blind controls allow for adjustment of the blind from either side of the wall in which the window is installed. Thus, with the window-installed in a wall between a patient's room and a nurses' station or a secured hallway, the patient can close the blind for privacy without leaving his or her room while a doctor or nurse can quickly view the patient by adjusting the blind without having to enter the patient's room.

The window is specifically dimensioned to fit in the glazing pocket of a window frame for a commercial building. Each blind control is positioned within the cavity formed by a side of the window and its corresponding glazing pocket in the window frame, and includes a knob mounted to an exterior surface of the window frame.

In an alternative embodiment for areas of a hospital where control of the blind is appropriate from only one side, the window includes only one blind control. Thus, for example, a doctor or nurse working in a hospital nursery can close the blind for privacy while caring for a baby without concern that a visitor may inadvertently open the blind.

Accordingly, it is a principal object of the invention to provide an interior window with an integrated blind that can be adjusted from either side of the wall in which the window is installed.

It is another object of the invention to provide an interior window with an integrated blind that is adapted for use in the glazing pocket of a standard size window frame for a commercial building.

Still another object of the invention is to provide an interior window with an integrated blind in which the blind controls are extremely simple and inexpensive.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
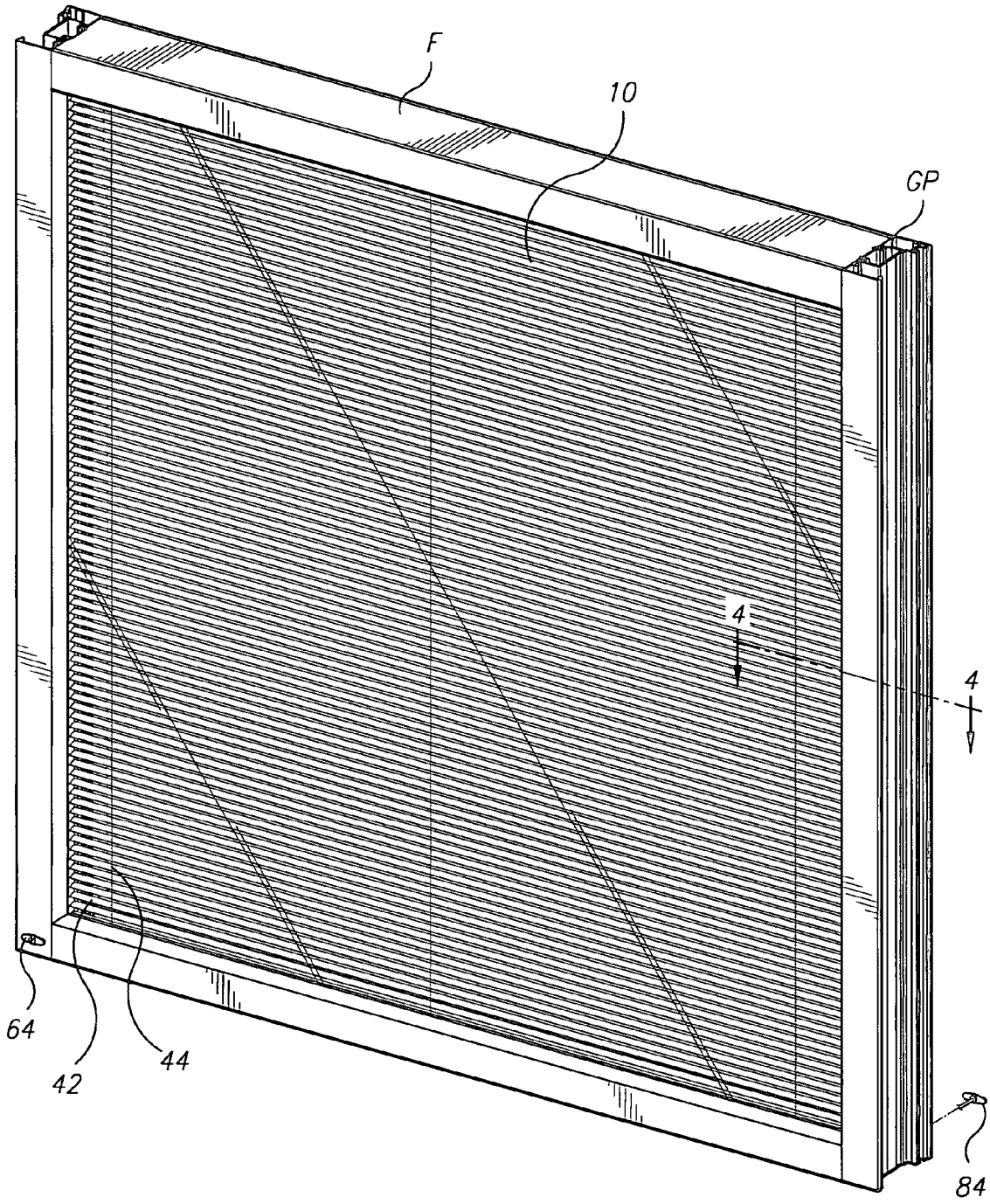
FIG. 2 is a perspective view of an interior window with integrated blind according to the present invention shown mounted in a window frame configured for a commercial building.
Figure 3:
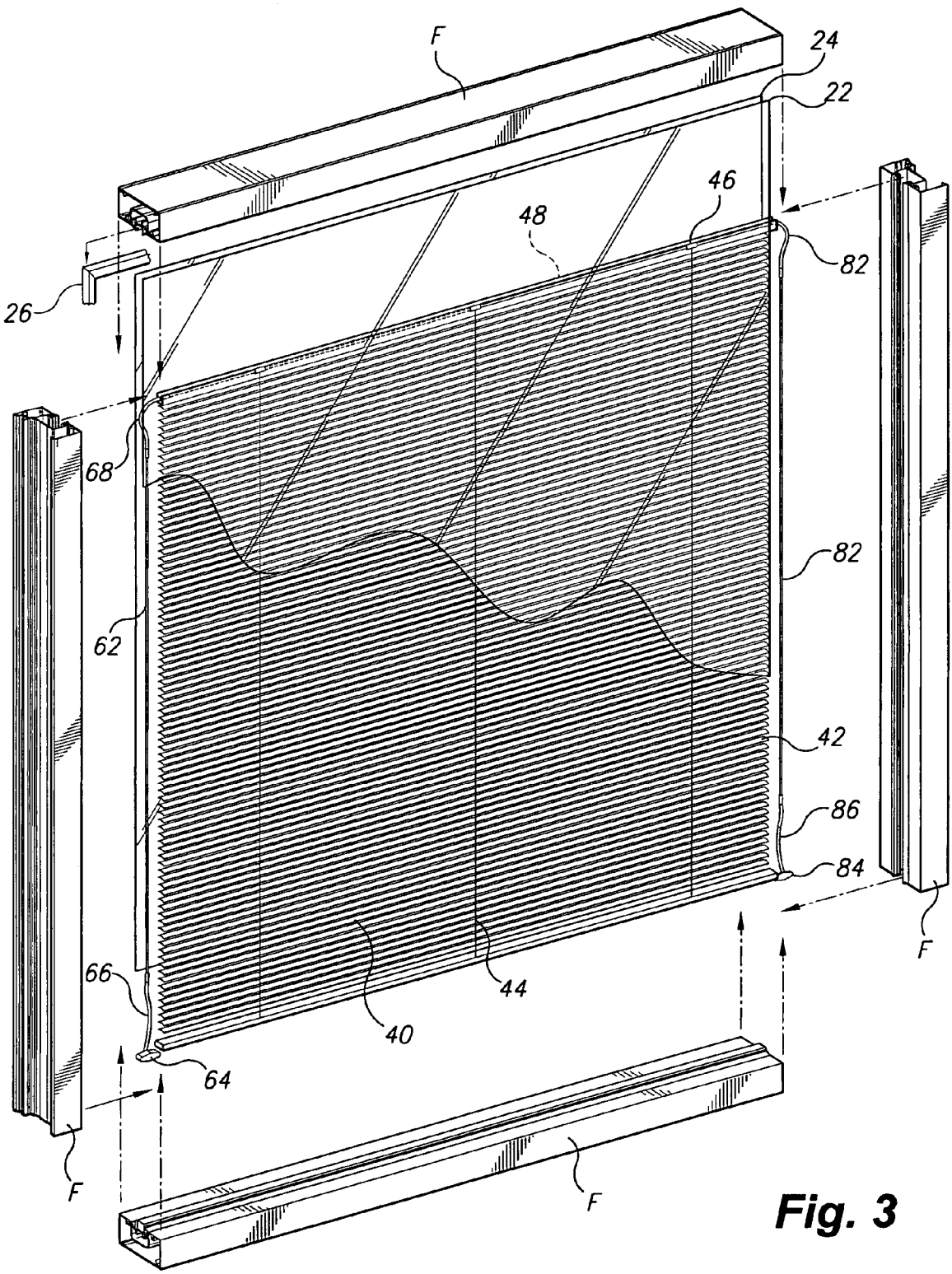
FIG. 3 is an exploded view of FIG. 2.
Figure 4:
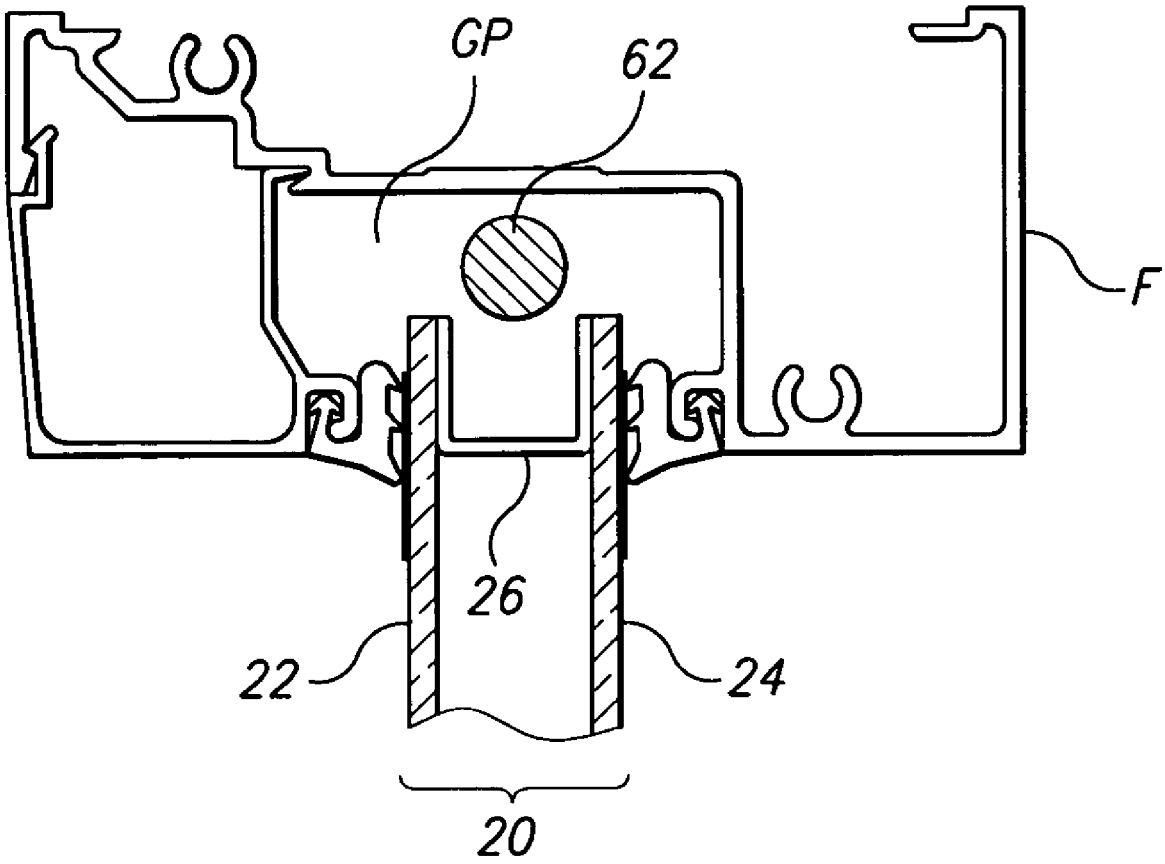
FIG. 4 is a fragmented, cross-sectional view, drawn along lines 4—4 of FIG. 2, of an interior window with integrated blind according to the present invention.

The present invention is an interior window with integrated blind, designated generally as 10 in the drawings, that is adapted for use in a hospital setting to provide a patient with privacy in his or her room while allowing a doctor or nurse to easily view the patient without having to enter the patient's room. Referring to FIGS. 2, 3 and 4, the window 10 includes a substantially airtight encasement 20, a blind assembly 40 encased within the substantially airtight encasement 20, and a separate blind control 60 and 80 extending from each of the two sides of the substantially airtight encasement 20.

The substantially airtight encasement 20 is formed from two ⅛ inch thick panes of glass 22 and 24 that are secured to opposite sides of a spacer frame 26. The airtight encasement 20 has a thickness of about one inch, which allows for mounting in the glazing pocket GP of a standard size window frame F configured for a commercial building.

The blind assembly 40 includes a plurality of slats 42 suspended on three parallel slat-tilting ladders 44. Each of the slat-tilting ladders 44 extends downwardly from a corresponding rotating tube 46 that is attached to a horizontal rod 48. Thus, rotating the horizontal rod 48, which passes through the three rotating tubes 46, controls the tilt of the slats 42. The blind assembly 40 has an overall thickness of ⅝ of an inch and is encased within the substantially airtight encasement 20.

The left blind control 60 extends from the left side of the substantially airtight encasement 20 and includes a vertical rod 62, a knob 64, an upper cable 68 and a lower cable 66. The lower cable 66 extends between the knob 64 and the vertical rod 62, and the upper cable 68 extends between the vertical rod 62 and the horizontal rod 48 in the substantially airtight encasement 20. Rotating the knob 64 causes the lower cable 66, the vertical rod 64, the upper cable 68, the horizontal rod 48, and each of the rotating tubes 46 to rotate, thereby adjusting each of the slat-tilting ladders 44 and the plurality of slats 42.

Likewise, the right blind control 80 extends from the right side of the substantially airtight encasement 20 and also includes a vertical rod 82, a knob 84, an upper cable 88 and a lower cable 86. The lower cable 86 extends between the knob 84 and the vertical rod 82, and the upper cable 88 extends between the vertical rod 82 and the horizontal rod 48 in the substantially airtight encasement 20. Rotating the knob 84 causes the lower cable 86, the vertical rod 82, the upper cable 88, the horizontal rod 48, and each of the rotating tubes 46 to rotate, thereby adjusting each of the slat-tilting ladders 44 and the plurality of slats 42.

The window 10 is installed in a standard size window frame F configured for a commercial building with each blind control 60 and 80 positioned within the cavity formed by a side of the window 10 and its corresponding glazing pocket GP in the window frame F. Each knob 64 and 84 is mounted to an exterior surface of the window frame F and is in rotational communication with the lower cable 66 and 86 inside the window frame cavity GP.

Figure 1:
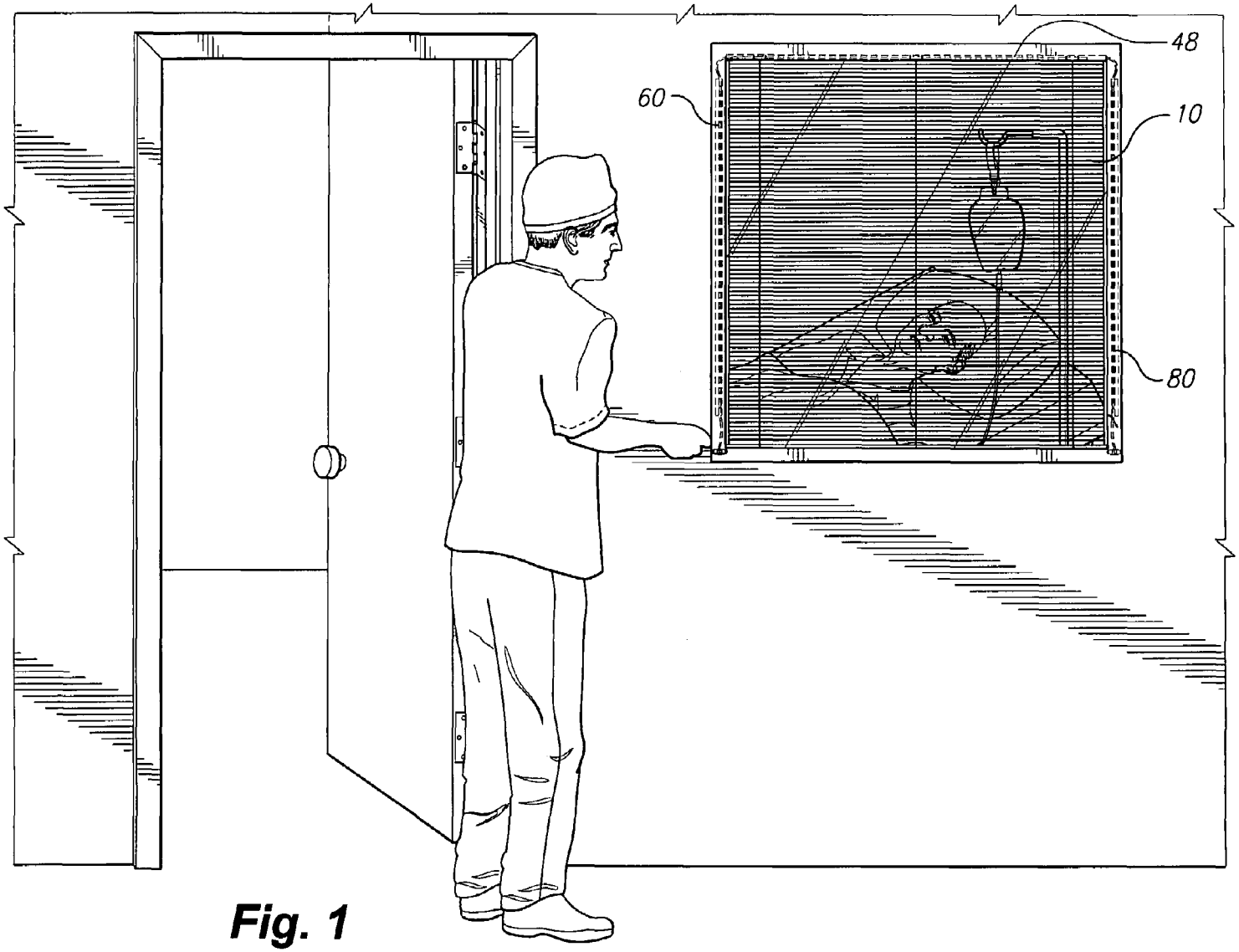
FIG. 1 is an environmental, perspective view of an interior window with integrated blind according to the present invention shown installed in a wall between a hospital room and a secured hallway.

When installed in a wall between a patient's room and a nurses' station or a secured hallway, as shown in FIG. 1, the window 10 allows the patient to close the blind for privacy in his or her room while also allowing a doctor or nurse to quickly view the patient by adjusting the blind from outside the patient's room.

In an alternative embodiment configured for areas of a hospital where control of the blind is appropriate from only one side of the window, the invention includes only one blind control. This embodiment is identical to the first embodiment 10 with the exception that one of the blind controls 60 and 80 is missing. Thus, for example, a doctor or nurse working in a hospital nursery can close the blind while caring for a baby without concern that a visitor might inadvertently open the blind.

It is to be understood that the present invention is not limited to the embodiments described above, but encompasses any and all embodiments within the scope of the following claims.

We claim:

1. An interior window with integrated blind, comprising:

a substantially airtight encasement formed from a pair of panes of glass secured to opposite sides of a rectangular spacer frame;

a blind assembly having a plurality of slats suspended on at least two parallel slat-tilting ladders;

each of said slat-tilting ladders extending downwardly from a corresponding rotating tube; each of said rotating tubes attached to a horizontal rod; said horizontal rod having a first and second end; and said blind assembly encased within said substantially airtight encasement;

a left blind control having a vertical rod, a knob, an upper cable and a lower cable; said vertical rod having an upper end and a lower end; said upper cable extending from said upper end of said vertical rod through said spacer frame to said first end of said horizontal rod; said lower cable extending from said lower end of said vertical rod to said knob; and a right blind control having a vertical rod, a knob, an upper cable and a lower cable; said vertical rod having an upper end and a lower end; said upper cable extending from said upper end of said vertical rod through said spacer frame to said second end of said horizontal rod; said lower cable extending from said lower end of said vertical rod to said knob;

whereby, when said knob of said left blind control is rotated, said lower cable of said left blind control, said vertical rod of said left blind control, said upper cable of said left blind control, said horizontal rod, and each of said rotating tubes are rotated thereby adjusting each of said slat-tilting ladders and said plurality of slats; and whereby, when said knob of said right blind control is rotated, said lower cable of said right blind control, said vertical rod of said right blind control, said upper cable of said right blind control, said horizontal rod, and each of said rotating tubes arc rotated thereby adjusting each of said slat-tilting ladders and said plurality of slats.

2. The interior window with integrated blind according to claim 1, wherein said substantially airtight encasement is shaped and dimensioned to fit within the glazing pocket of a window frame for commercial building.

3. The interior window with integrated blind according to claim 1, wherein said substantially airtight encasement has a thickness of about one inch.

* * * * *